United States Patent [19]

Bartels

[11] 4,154,066

[45] May 15, 1979

[54] NEEDLE SELECTION UNIT FOR A HAND KNITTER

[75] Inventor: Manfred Bartels, Cologne, Fed. Rep. of Germany

[73] Assignee: Empisal Knitmaster Luxembourg S.A., Luxembourg, Luxembourg

[21] Appl. No.: 839,917

[22] Filed: Oct. 6, 1977

[51] Int. Cl.[2] ..... D04B 7/00

[52] U.S. Cl. ..... 66/75.2

[58] Field of Search ..... 66/60 H, 75.2

[56] References Cited

U.S. PATENT DOCUMENTS

| | | | |
|---|---|---|---|
| 3,472,287 | 10/1969 | Ribler | 66/75.2 X |
| 3,518,845 | 7/1970 | DeCerjat | 66/75.2 X |
| 3,771,327 | 11/1973 | Engelfried | 66/50 R |
| 3,771,328 | 11/1973 | Schindele et al. | 66/50 R |
| 3,861,173 | 1/1975 | Kinkelin | 66/50 R |
| 3,863,465 | 2/1975 | DeCerjat et al. | 66/50 R |
| 3,892,108 | 7/1975 | Hadam | 66/75.2 |
| 4,006,611 | 2/1977 | Kahan et al. | 66/75.2 |

FOREIGN PATENT DOCUMENTS

| | | | |
|---|---|---|---|
| 2361746 | 6/1974 | Fed. Rep. of Germany | 66/75.2 |

*Primary Examiner*—Werner H. Schroeder
*Assistant Examiner*—Andrew M. Falik
*Attorney, Agent, or Firm*—Spensley, Horn, Jubas & Lubitz

[57] ABSTRACT

In the carriage of a hand knitter, the guide track includes a bifurcation formed by two elongated permanent magnets, opposite poles of which face each other across the bifurcation to form a nearly homogeneous magnetic field. Also mounted on the carriage, above the guide track bifurcation, is an electromagnet the axis of which is vertically aligned with the middle of the bifurcation. When energized, the electromagnet produces a field which reinforces the permanent magnetic field on one side of the vertical axis and opposes, and thereby decreases the field on the other side. As a result, a foot of the needle is attracted into the bifurcated track guide on the side having the reinforced magnetic field and follows this path which is defined by the corresponding elongated permanent magnet. Very little energy is used to accomplish needle setting in this manner, wherein the electromagnet setting signals are provided just as the needle foot enters the bifurcation.

3 Claims, 4 Drawing Figures

NEEDLE SELECTION UNIT FOR A HAND KNITTER

The invention relates to a control unit for a hand knitter having a plurality of knitting needles arranged in a needle bed. A carriage is movable on the needle bed transversely to the knitting needles and has a guide track which engages upstanding feet of the knitting needles to move them transversely to the direction of movement of the carriage, in order to carry out the knitting operation. At least one selection device is provided on the carriage which introduces the knitting needles via a bifurcation into different tracks of travel. The selection device has an electro magnet excited in response to the signals supplied from a store and which produces a magnetic field for influencing the knitting needles running into the bifurcation, and two permanent magnets which produce a nearly uniform magnetic field with which the field of the electromagnet interacts.

In the known hand knitters, a carriage also referred to as a cam, is reciprocated on the needle bed and transversely to the needles during the knitting operation. At the lower face of the carriage, there are cam tracks into which engage the upstanding needle feet during the reciprocatory movement so that the needles are displaced in a direction transverse to that of the movement of the carriage. If certain patterns are to be knitted with a knitter of this kind, the pattern information for the needles of a row is stored in the carriage. While the carriage is moved over the needle bed, the store passes the information associated with the individual needles to the needles by causing them to enter each of two possible tracks of travel on the carriage. The tracks of travel impart different movements to the needles during the knitting operation so that threads of different colors, for example, can be picked up and worked by the needles.

In a known knitter (Swiss Pat. No. 460, 232) the control or adjustment of the individual needles is realised by magnets fitted at the carriage and which can be controlled selectively when running along the needle feet. To this effect, two permanent magnets and one electromagnet are provided. The permanent magnets are arranged at both sides of the track where the needle feet move relatively to the carriage and both permanent magnets have an attractive effect on the needle foot concerned which is between them. The electromagnet is arranged above the permanent magnets and may be polarized in two different directions. In one direction of polarisation, the magnetic field of the electromagnet reduces the field of the left-hand permanent magnet, while that of the right-hand permanent magnet is increased, and, in the other direction of polarization, the electromagnet intensifies the field of the left-hand permanent magnet, while the field of the right-hand permanent magnet is reduced. As a result, the needle feet concerned is drawn either to the right or to the left to enter a corresponding guide track.

It is the object of the instant invention to provide a control unit of the type mentioned at the outset hereof which is of a simpler construction than the known control units and which permits a more effective utilisation of the magnetic fields.

To solve this problem, it is provided according to the invention that the poles of the permanent magnets are oppositely located at the bifurcated way, with different polarities and that they generate in the guide track a nearly homogeneous magnetic field, the electromagnet being fitted directly above the guide track with vertical axis.

In the control unit of the invention, the two permanent magnets generate a nearly homogeneous magnetic field passing transversely through the guide track. This magnetic field is superimposed by the magnetic field of the electromagnet intensifying the permanent magnetic field on the one side and reducing it on the other side. As a result, the field distribution is very simple, while the magnetic forces for the needle displacement are utilised favorably. Moreover, the design of the selection device is very favorable.

A preferred embodiment of the invention will now be described in greater detail by reference to the attached drawings, in which.

Figure 1:
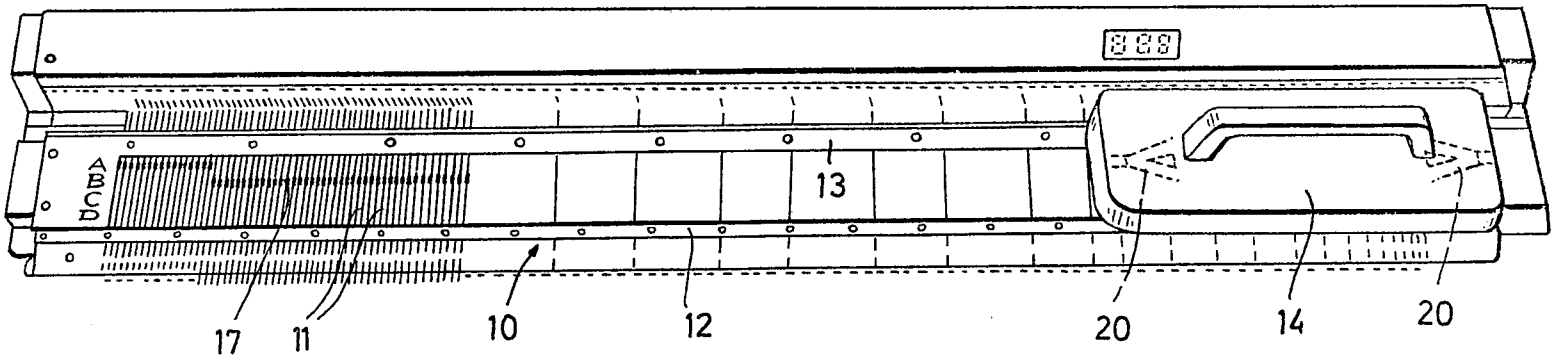
FIG. 1 illustrates diagrammatically the external structure of a hand knitter in accordance with the invention.

The hand knitter illustrated in FIG. 1 has a needle bed 10 with a large number of parallel knitting needles 11 which are individually displaceable transversely of the needle bed 10. A carriage 14 is displaceable transversely to the needles over the entire needle bed 10, on two rails 12 and 13. The cam is moved by hand. At their outer ends the needles are bent upwards and formed as hooks 15 in which the threads can be fitted. Each needle has a pivoted tongue 16 which, in one of its end positions, closes the hook 15.

In that zone of the needle bed 10 between the rails 12 and 13 that is traversed by the carriage 14, the needles 11 have upwardly directed feet 17 which serve to displace and position the needles. Four different needle positions, A, B, C and D, are marked at the outer end of the needle bed 10. Those needles whose feet 17 are in the A position, are not engaged at all by the carriage 14 as it moves past them. They do not therefore participate in the knitting operation. Those needles whose feet are in the B position are actuated by a cam track, provided on the lower face of the carriage 14, so that they execute a certain movement transversely of the needle bed, and this results in a stitch being formed in the known manner. They are then moved back into the B position by the carriage 14, so that during the next return run of the cam they are engaged again. The C and D positions are not of importance to an understanding of the basic mode of operation of the machine.

Figure 2:
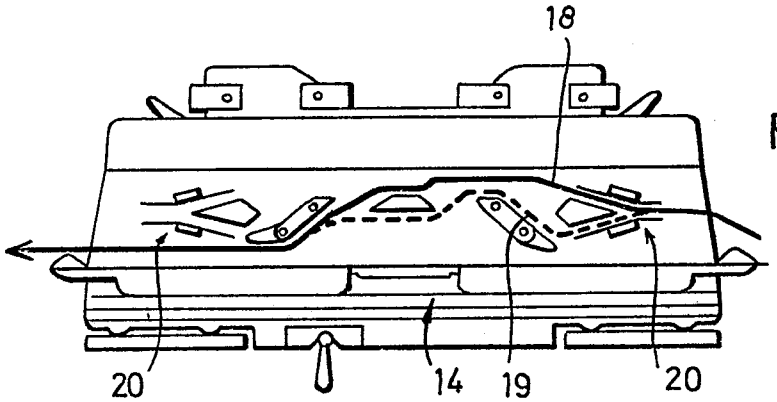
FIG. 2 shows diagrammatically an underneath view of the carriage.

For the purpose of knitting a pattern, the needles are so positioned that they pick up each of two differently coloured threads. Those needles that are to pick up the red threads, for example, must move in a time-cycle that is different from that of those needles that are to pick up the blue threads, for example. The needles are selected by the carriage 14 and are moved either along the cam track 18 or along the cam track 19 (FIG. 2). These two cam tracks finally join each other again so that all the needles that have entered the cam at the B position also leave it again at that position.

FIG. 2 illustrates the paths of the feet 17 of the needles only for when the carriage is moved in one direction (to the right). When the direction of movement of the carriage is reversed, the same cam tracks, which run from right to left in FIG. 2, run from left to right. The lower face of the cam is of symmetrical form. Points 20 are used for selecting the needles. These points are electromagnetically controlled and move the feet 17 of the needles either forwards or backwards, so that they are guided into the track of travel 18 or the track of travel 19. The points 20 are actuated in dependence upon the knitting pattern which can be stored either in an electro-mechanical or a magnetic store. The feed of the pattern data for a row of knitting into the store will not be described here since it is not of importance as regards construction of the points. The only thing of importance is that the impulses for energizing the electromagnets for actuating the points should be generated at the same rate as that at which the cam 14 passes the various needles 11 in the needle bed.

Figure 3:
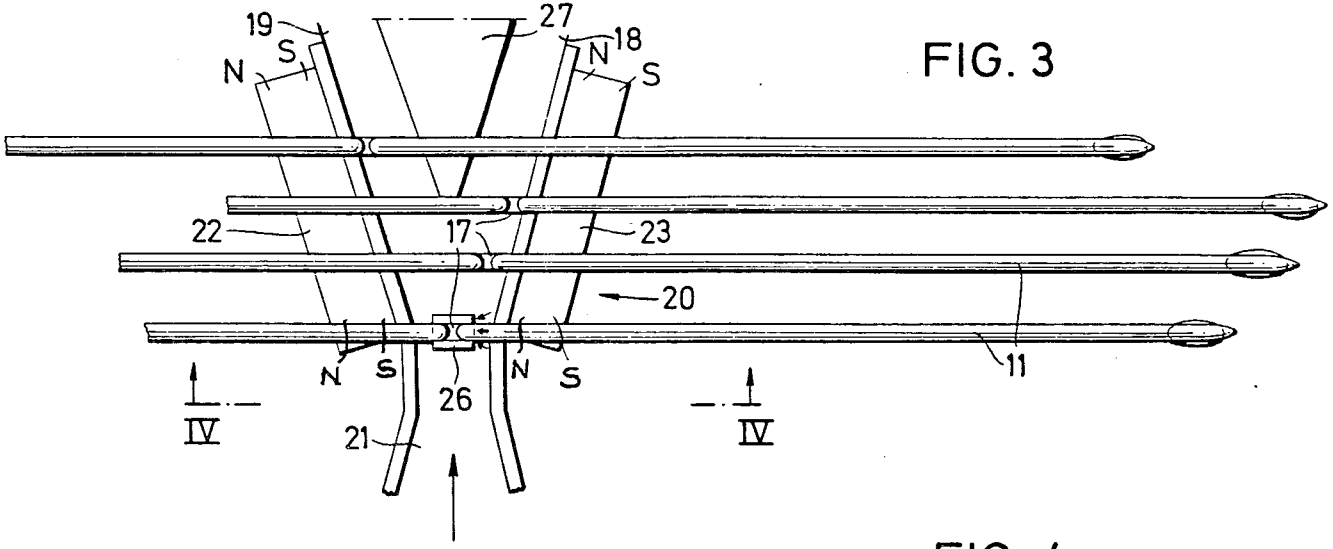
FIG. 3 is an underneath view, on a larger scale, illustrating the principle of the selection device.
Figure 4:
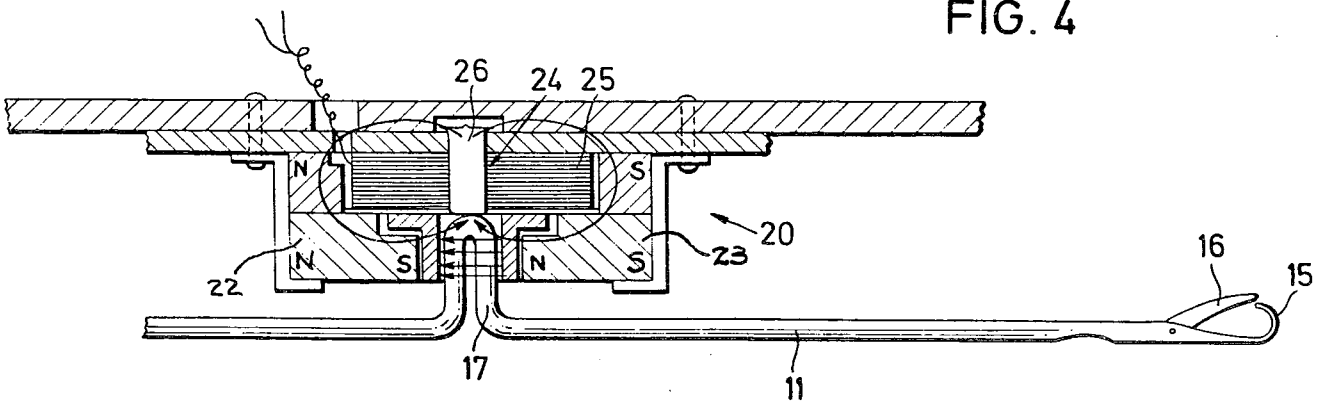
FIG. 4 is a section through the selection device on line IV—IV of FIG. 3.

In FIGS. 3 and 4 the points 20 are illustrated in detail. At the bifurcated track-portion at which the two tracks 18 and 19 diverge are arranged two permanent magnets 22 and 23. These are bar magnets which are disposed along the outer side-walls of the tracks 18 and 19. The lateral limiting walls of the tracks or ducts are faced with non-magnetic material which permits the passage therethrough of the magnetic fields of the permanent magnets 22 and 23 and which makes gentle frictional contact with the feet 17 of the needles. This material is merely intended to form a means for guiding the feet of the needles. The bar-shaped permanent magnets 22 and 23 arranged along the tracks 18 and 19, are of such polarity that, at the inlet point of the bifurcated track-portion, the north pole of one of the permanent magnets is disposed opposite the south pole of the other permanent magnet. The electromagnet 24 is arranged at this point above the guide track for the oncoming feet 17 of the needles. This electromagnet consists of a magnet coil 25, the axis of which is disposed vertically and in which is provided a likewise vertical core 26. The core 26 of the coil terminates immediately above the needle feet 17 which pass below it.

The inner limiting walls of the tracks 18 and 19 are formed by a wedge-shaped deflector 27. Between the position of the magnet core 26 and the tip of the wedge-shaped deflector 27, the feet 17 of the needles must be deflected either to the right or to the left.

The two magnetic fields, one superposed upon the other, are shown in FIG. 4. At the branch-point of the path along which the feet of the needles move, the permanent magnets 22 and 23 set up an almost uniform magnetic field which would not apply any force to the feet 17 of the needles along the plane of symmetry of the track of travel. However, as shown in FIG. 4, the field of the electromagnet 24 is superposed upon this magnetic field. It will be seen that, with the polarization illustrated, the flux lines are cumulative to the right of the vertical axis of the magnetic core 26, whereas to the left of the vertical axis of the magnetic core they are reduced or cancelled out. With the polarization illustrated, the foot 17 of a needle that had just passed below the magnetic core 26 would be attracted to the right, as seen in FIG. 4. When it has, in this way, left the axis of symmetry of the points, it moves into a zone where it is more greatly influenced by the permanent magnet 23 and is attracted thereby. Thus, a relatively brief and weak impulse suffices to move the foot of the needle from the axis of symmetry of the points and to direct it into the zone of influence of one of the two permanent magnets. The only important requirement is that the electromagnet 24 would be energized in pulses at precisely that moment at which the foot of the needle concerned is located immediately below the magnetic core 26.

What is claimed is:

1. A control unit for a hand knitter of the type having a plurality of knitting needles arranged in a needle bed, a carriage movable on the needle bed transversely to the knitting needles and having a guide track which engages the upstanding feet of said knitting needles to move said needles transversely to the direction of movement of the carriage in order to carry out the knitting operation, at least one selection device provided on the carriage for introducing the knitting needles at a bifurcation into different tracks of travel and which has an electromagnet excited by supplied signals so that the magnetic field of said excited electromagnet influences the knitting needles enterine the bifurcation, and which has two permanent magnets mounted on opposite sides of said bifurcation, the improvement wherein:

the poles of the permanent magnets are oppositely located at the bifurcation with different polarities to generate across the guide track a nearly homogeneous magnetic field, and wherein:

the electromagnet is arranged directly above the guide track with its axis extending vertically through the middle of said bifurcation, so that when excited, the resultant field of said electromagnet will reinforce the field of said permanent magnets on one side of said bifurcation and will oppose and thereby decrease the magnetic field of said permanent magnets on the other side of said bifurcation.

2. A control unit according to claim 1 wherein said two permanent magnets are elongated and are mounted to said carriage to diverge in a V-shape away from the location of said electromagnet, and a wedge-shaped deflector mounted to said carriage between said permanent magnets, each magnet and a respective side of said wedge defining the sides of alternate guide tracks diverging from said bifurcation, said electromagnet being mounted in alignment with the apex of said wedge shaped deflector, so that as a needle foot passes beneath the vertical axis of said electromagnet it will be deflected transversely in the direction of the reinforced magnetic field and will follow the corresponding guide track under influence of the associated guide track defining permanent magnet.

3. In a hand knitter of the type having a plurality of needles arranged on a needle bed, each of said needles having an upstanding, magnetically attractable foot, and a carriage movable across said needle bed and having a guide track engaging said needle feet, the improvement comprising:

first and second elongated permanent magnets mounted on said carriage in divergent relationship to each other so as to form opposite sides of a pair of alternate paths extending from a guide track bifurcation, the north pole of one permanent magnet facing the south pole of the other permanent magnet so as to produce across said guide track bifurcation a uniform magnetic field between said facing north and south poles, an electromagnet mounted on said carriage at said guide track bifurcation with the axis of said electromagnet being aligned vertically above the center thereof, and means for selectively energizing said electromagnet as the foot of a needle passes through said guide track bifurcation, the resultant magnetic field of said electromagnet reinforcing the homogeneous magnetic field on one side of said bifurcation and decreasing the homogeneous magnetic field on the other side, whereby said foot will be attracted in the direction of the reinforced field, the needle foot thereafter being directed along the corresponding divergent path under the influence of the elongated permanent magnet forming the side of that path.

* * * * *